US012709785B2

(12) United States Patent
Melsert et al.

(10) Patent No.: US 12,709,785 B2
(45) Date of Patent: Aug. 18, 2026

(54) COMPOSITIONS AND SYSTEMS FOR SELECTIVE LITHIUM LEACHING AND RELATED METHODS

(71) Applicant: American Battery Technology Company, Reno, NV (US)

(72) Inventors: Ryan Mitchell Melsert, Reno, NV (US); Jiajia Meng, Newark, CA (US)

(73) Assignee: American Battery Technology Company, Reno, NV (US)

( * ) Notice: Subject to any disclaimer, the term of this patent is extended or adjusted under 35 U.S.C. 154(b) by 855 days.

(21) Appl. No.: 17/952,154

(22) Filed: Sep. 23, 2022

(65) Prior Publication Data

US 2023/0102673 A1 Mar. 30, 2023

Related U.S. Application Data

(60) Provisional application No. 63/248,054, filed on Sep. 24, 2021.

(51) Int. Cl.

| | |
|---|---|
| ***C22B 26/12*** | (2006.01) |
| ***C22B 3/06*** | (2006.01) |
| ***C22B 3/08*** | (2006.01) |
| ***C22B 3/10*** | (2006.01) |

(52) U.S. Cl.

CPC ..... *C22B 26/12* (2013.01); *C22B 3/065* (2013.01); *C22B 3/08* (2013.01); *C22B 3/10* (2013.01)

(58) Field of Classification Search

CPC ..... C22B 26/12; C22B 3/065; C22B 3/08; C22B 3/10; C22B 61/422; C22B 3/44; Y02P 10/20

USPC ..... 423/179.5

See application file for complete search history.

(56) References Cited

U.S. PATENT DOCUMENTS

| | | | | |
|---|---|---|---|---|
| 3,099,527 | A * | 7/1963 | Howling | C22B 26/12 423/551 |
| 5,431,788 | A | 7/1995 | Jones | |
| 10,648,090 | B2 | 5/2020 | Snydacker et al. | |
| 11,697,861 | B2 | 7/2023 | Bourassa et al. | |
| 2007/0209481 | A1 * | 9/2007 | Pereira | C22B 23/043 75/743 |
| 2016/0258071 | A1 | 9/2016 | Magnan et al. | |
| 2018/0148342 | A1 | 5/2018 | Park et al. | |
| 2019/0136392 | A1 | 5/2019 | Bourassa et al. | |
| 2019/0233297 | A1 | 8/2019 | Kim et al. | |
| 2021/0207243 | A1 | 7/2021 | Sun et al. | |

(Continued)

FOREIGN PATENT DOCUMENTS

| | | | | |
|---|---|---|---|---|
| CN | 1687468 | A * | 10/2005 | |
| CN | 104495880 | A * | 4/2015 | |
| CN | 110042262 | A * | 7/2019 | C22B 1/02 |

(Continued)

OTHER PUBLICATIONS

English translation of CN-110042262-A Description. (Year: 2019).*

(Continued)

*Primary Examiner* — Anthony J Zimmer
*Assistant Examiner* — Zachary John Baum
(74) *Attorney, Agent, or Firm* — Wolf, Greenfield & Sacks, P.C.

(57) ABSTRACT

Compositions, systems, and methods for selectively leaching and/or extracting lithium from sedimentary deposits and other resources are generally described.

19 Claims, 5 Drawing Sheets

(56) References Cited

U.S. PATENT DOCUMENTS

2023/0098644 A1 3/2023 Melsert et al.

FOREIGN PATENT DOCUMENTS

| | | | |
|---|---|---|---|
| CN | 113151680 | A | 7/2021 |
| KR | 2022-0089545 | A | 6/2022 |
| WO | WO 2020/205302 | A1 | 10/2020 |
| WO | WO 2021/142147 | A1 | 7/2021 |

OTHER PUBLICATIONS

English translation of CN-104495880-A Description. (Year: 2015).*
English translation of CN-1687468-A Description. (Year: 2005).*
PCT/US2022/044585, Feb. 2, 2023, International Search Report and Written Opinion.
PCT/US2022/044587, Feb. 17, 2023, International Search Report and Written Opinion.
International Search Report and Written Opinion mailed Feb. 9, 2023 in connection with International Application No. PCT/US2022/044585.
International Search Report and Written Opinion mailed Feb. 17, 2023 in connection with International Application No. PCT/US2022/044587.
Birk, Sulfate Ion ($SO_4^{2-}$). Arizona State University. Jun. 5, 2019 (last retrieved Nov. 30, 2022). 1 page.
Liu et al., Treatment of raffinate generated via copper ore hydrometallurgical processing using a bipolar membrane electrodialysis system. Chemical Engineering Journal. Sep. 24, 2019; vol. 382 (2020) 122956; 10 pages.
Meshram et al., Extraction of lithium from primary and secondary sources by pre-treatment, leaching and separation. A comprehensive review. Hydrometallurgy. Oct. 2014. 2;150:192-208.

* cited by examiner

COMPOSITIONS AND SYSTEMS FOR SELECTIVE LITHIUM LEACHING AND RELATED METHODS

CROSS-REFERENCE TO RELATED APPLICATIONS

This application claims the benefit of priority under 35 U.S.C. § 119(e) of U.S. Provisional Application Ser. No. 63/248,054, filed Sep. 24, 2021, the disclosure of which is incorporated herein by reference in its entirety.

TECHNICAL FIELD

Compositions, systems, and methods for leaching and/or extracting lithium are generally described.

BACKGROUND

While the demand for lithium products is expected to grow by over 10 times over the next 10 years, the majority of the supply growth to meet this near insatiable demand is expected to be harvested from conventional resources, which consist of high salinity brines and lithium-rich hard rock resources (e.g., pegmatites). However, these resources are not geographically accessible in regions with the highest demand for lithium products. In addition, extracting lithium from hard rock and brine resources presents a host of challenges, including intensive physicochemical processing.

SUMMARY

Compositions, systems, and methods for selectively leaching and/or extracting lithium from sedimentary deposits are described herein. The subject matter of the present disclosure involves, in some cases, interrelated products, alternative solutions to a particular problem, and/or a plurality of different uses of one or more systems and/or articles.

In one aspect, a composition is described comprising an acid, an oxidant, and a sedimentary ore in contact with the acid and/or the oxidant.

In another aspect, a system is described, the system comprising a first chamber, an acid source in fluid communication with the first chamber, an oxidant source in fluid communication with the first chamber, and a sedimentary ore source operatively coupled with the first chamber, wherein the acid source, the oxidant source, and the sedimentary ore source are configured to combine an acid, an oxidant, and a sedimentary ore in the first chamber to dissolve at least a portion of a lithium species contained within the sedimentary ore into a solution.

In another aspect, a method of leaching lithium into a solution is described, the method comprising exposing sedimentary ore comprising a lithium species to an acid and an oxidant, flowing a liquid across the sedimentary ore, the acid, and/or the oxidant, and dissolving at least a portion of the lithium species into the liquid to form a leachate.

In another aspect, a method for extracting a species from a leachate is describe, the method comprising flowing the leachate comprising a first species and a second species to an electrodialysis stack, diffusing the first species across a first membrane, forming an acidic solution with the first species, diffusing the second species across a second membrane, forming a basic solution with the second species, forming a depleted leachate, and flowing a portion of at least one selected from the depleted leachate, the acidic solution, and the basic solution back into the electrodialysis stack.

In a different aspect, a system for extracting a species from a leachate is described, the system comprising an electrodialysis stack comprising a first outlet a second outlet, and a third outlet, wherein the electrodialysis stack is configured to flow the leachate through the electrodialysis stack to form a depleted leachate that flows through the first outlet, to diffuse a first species within the leachate across a first membrane to form an acidic solution that flows through the second outlet, and diffuse a second species within the leachate across a second membrane to form a basic solution that flows through the third outlet; a first chamber in fluid communication with the second outlet of the electrodialysis stack such that the acidic solution flows from the first outlet of the electrodialysis stack to the first chamber; and a second chamber in fluid communication with the third outlet of the electrodialysis stack such that the basic solution flows from the second outlet of the electrodialysis stack to the second chamber, wherein an outlet of the first chamber is in fluid communication with the second chamber, and wherein an outlet of the second chamber is in fluid communication with the electrodialysis stack.

In yet another aspect, a system for extracting a species from a leachate, is describe the system comprising an electrodialysis stack comprising a first membrane and a second membrane, wherein the electrodialysis stack is configured to receive a leachate, diffuse a first species of the leachate across the first membrane to form an acidic solution, and diffuse a second species of the leachate across the second membrane to form a basic solution; a first chamber in fluidic communication with the electrodialysis stack, wherein the first chamber is configured to receive the acidic solution from the electrodialysis stack; and a second chamber in fluidic communication with the electrodialysis stack and the first chamber, wherein the second chamber is configured to receive the basic solution from the electrodialysis stack, wherein the electrodialysis stack is configured to receive a depleted leachate from an outlet of the electrodialysis stack.

Other advantages and novel features of the present disclosure will become apparent from the following detailed description of various non-limiting embodiments of the disclosure when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present disclosure will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Figure 1A:
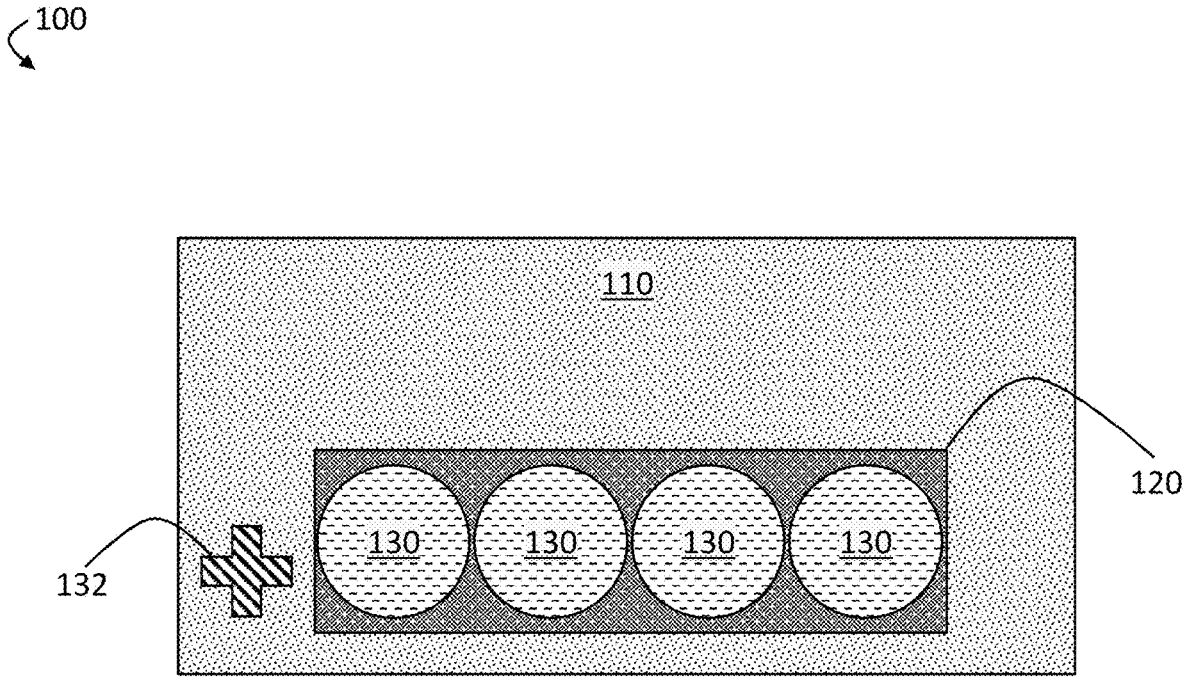
FIGS. 1A-1B show cross-sectional schematic side views of a vessel containing a composition for leaching lithium from a sedimentary ore, according to one set of embodiments.

Many lithium deposits or products are extracted from conventional sources, such as hard rocks (e.g., pegmatites) or brine resources. However, both of these resources suffer from significant drawbacks. To start, both hard rock and brine resources suffer from geographical limitations and may not be readily available in areas most in need of lithium. In addition, with conventional hard rock resources, the lithium is tightly bound within the lattice structure, such as within oxides and silicates within the hard rock and may require intensive physical and chemical processes to liberate the lithium. Intensive physical and chemical processes include calcining, roasting, and leaching, and may sometimes require highly concentrated acids to liberate the lithium, which increases both cost and the number of processing steps required in order to extract the lithium.

High-salinity brine resources, by contrast, contain lithium that is more readily accessible when compared to hard rock lithium deposits. In brines, the lithium is in an aqueous phase and may be very accessible; however, while the lithium may be present at a relatively high concentration (1,000-1,900 ppmw), the relative concentration of other dissolved species may be much higher (>300,000 ppmw), hence the selectivity for lithium over other species within the brine may be relatively low. As a result, a complicated set of separation, purification, and concentration processes may be required to separate the lithium from the other dissolved species within the brine. Additionally, the overall concentration of lithium in conventional brine resources is typically relatively low in comparison to conventional hard rock resources, and, in some cases, it may take prohibitively long amounts of time (e.g., 18-24 months) in order to concentrate and purify these low concentration lithium brine resources through conventional evaporation ponds.

One relatively underutilized lithium resource is sedimentary resources (e.g., ore, claystone), a resource that is highly prevalent in the western region of the United States. Sedimentary resources may be rich in lithium. The Inventors have recognized and appreciated that, in contrast to conventional hard rock lithium deposits, the lithium of sedimentary resources is more loosely bound within the sediment, similar to how lithium is hosted and loosely held within the active cathode material inside lithium-ion batteries and may be easier to leach and extract. Without wishing to be bound by any particular theory, the lithium within the sedimentary deposits may be present within interlayer or intralayer regions within the deposit, or adsorbed or absorbed on or within the sediment, which may allow the lithium to be more readily extracted from these sedimentary deposits when compared to hard rock resources.

In view of the above, the Inventors have recognized and appreciated that, by using an oxidant, lithium can be more easily selectively leached and/or extracted from sedimentary ore relative to certain conventional lithium sources and may require relatively less physicochemical processing than is required when processing these conventional lithium resources. The sedimentary ore can be suspended in a solution containing the oxidant, and the oxidant may oxidize other metal constituents in the sedimentary resource and weaken the ionic bonds of lithium ions to other anions, therefore lowering the energy required for releasing it into the solution. In some cases, the solution also contains an acid, such that the combined reaction to the oxidant and the acid facilitates leaching of lithium from the sedimentary ore. Once the lithium has been leached from the sedimentary ore, the solution (leachate) containing the lithium may be further processed so as to extract the lithium from the leachate. In some cases, the leaching of lithium from the sedimentary ore may be selective relative to other species contained within the sediment. For example, a larger proportion of the lithium may be leached from the sedimentary ore using the disclosed processes as compared to the proportion of non-lithium species leached from the sedimentary ore. This may advantageously improve a recovery rate of lithium relative to these other elements within the sedimentary ore.

It has also been recognized and appreciated by the Inventors that certain downstream chemical species may be reused or recycled during the lithium extraction process. For example, in some cases, the extraction process may generate acidic and/or basic solutions while isolating the lithium. In some instances, the acidic solution generated may be used as an acid source to continue to leach lithium from a sedimentary ore, and in some instances, the base generated may be used as a source of basic solution useful in processing the leachate, for example, by facilitating the precipitation of undesired metal cations from the leachate. In certain conventional systems, the concentration of acid (or base) is relatively high, which can result in damage to components of those conventional systems if not diluted from the relatively high concentrations used during the leaching process prior to further processing. However, it has been discovered within the context of the present disclosure that the relatively lower concentration of the acidic and/or basic solutions used in the disclosed systems is such that these solutions may either be used in the additional processing steps without dilution and/or may be easily recycled into various points of the process. This may provide for a more efficient process and may reduce, or eliminate, the need for outside sources of certain chemical species, such as concentrated acids. In some instances, the lithium extracted from sedimentary resources may be used to produce battery-grade lithium products.

As mentioned above, it has been recognized and appreciated that an oxidant may be used to aid in leaching lithium from a sedimentary ore. Accordingly, compositions, systems, and methods described herein may comprise an oxidant. An oxidant is given its ordinary meaning in the art to describe an oxidizing agent or an oxidizer that can oxidize (i.e., remove electrons from) a chemical species. Without wishing to be bound by any particular theory, it is believed that the oxidant reacts or interacts with sedimentary ore such that lithium ions are more readily dissolved from the sedimentary ore into solution. In some embodiments, such interaction may be intensified when the oxidant contains sodium or potassium ions that has a close ionic radius to lithium. Without wishing to be bound by any particular theory, these ions when dissociated in water at sufficient concentration can facilitate lithium extraction via an ion exchange mechanism. However, the reaction may also take place in the solid state, when a solid oxidant (e.g., sodium persulfate) is used. In such an embodiment, the solid oxidant may be placed in contact with the sedimentary ore to facilitate a solid-state reaction between the two reactants. A liquid (e.g., water, a solvent) may then be flowed over and/or percolated through the solid(s) so as to leach the lithium into the liquid to form a leachate. In some embodiments, oxidizing the sedimentary ore may selectively dissolve lithium ions into solution in a greater proportion relative to the original composition of the sedimentary ore as compared to at least some of the other metallic species (e.g., Mg, Mn, Al, Fe) within the sedimentary ore. In some instances, the oxidant may be combined with an acid to produce a synergistic effect that enhances the oxidation. This effect is discussed in more detail elsewhere herein.

When leaching lithium from a sedimentary ore, an oxidant may be present in a particular mass ratio relative to the sedimentary ore. In some embodiments, a mass ratio of oxidant to sedimentary ore is greater than or equal to 0.01, 0.02, 0.03, 0.04, 0.05, 0.07, 0.1, 0.2, 0.3, 0.4 or 0.5. In some embodiments, the mass ratio of oxidant to sedimentary ore is less than or equal to 0.5, 0.4, 0.3, 0.2, 0.1, 0.07, 0.05, 0.04, 0.03, 0.02, or 0.01. Combinations of the foregoing are also contemplated including, for example, a mass ratio of oxidant to sedimentary ore that is between or equal to 0.01 and 0.5. Other ranges are possible.

When leaching lithium from a sedimentary ore, in some embodiments, a weight percentage of oxidant to sedimentary ore is less than or equal to 5 wt %, less than or equal to 4 wt %, less than or equal to 3 wt %, less than or equal to 2 wt %, or less than or equal to 1 wt %. In some embodiments, the weight percentage of oxidant to sedimentary ore is greater than or equal to 1 wt %, greater than or equal to 2 wt %, or greater than or equal to 3 wt %. Combinations of the foregoing are also contemplated including, for example, a weight percentage between or equal to 1 wt % and 5 wt %. Of course, other ranges are also contemplated as this disclosure is not so limited.

Any suitable oxidant may be used in the various systems and methods disclosed herein. In some embodiments, the oxidant is, or comprises, a peroxide. Non-limiting examples of peroxides include hydrogen peroxide ($H_2O_2$) or persulfates and salts thereof. In an exemplary embodiment, the oxidant is sodium persulfate. In such an embodiment, sodium persulfate may be particularly advantageous as it may reduce, or substantially prevent, leaching of Na from the sedimentary ore (i.e., by preventing more Na ions from dissolving into the solution), while still acting as an oxidant to liberate lithium from the sedimentary ore. In some embodiments, the presence of high concentrations of aqueous Na ions in the leachate may assist with the selective leaching of Li through what is believed to be an ion exchange mechanism, whereas the high concentration of Na ions in the leachate provides a concentration gradient to exchange the aqueous Na ions with the Li ions held within the sedimentary resource. Of course, other oxidants may be used with the disclosed systems and methods as this disclosure is not so limited.

Compositions, systems, and methods described herein may also comprise an acid. Without wishing to be bound by any particular theory, the use of an acid may be done using controlled chemical loadings. If large amounts of acid are introduced (i.e., where the molar quantity of $H^+$ in the aqueous solution is much larger than the molar quantity of Li in the sedimentary resource), than bulk dissolution can occur, with many of the non-lithium species (e.g., Mn, Mg, Al, Fe) dissolving in addition to the Li. Of course, this would be non-desirable, and would result in a non-selective leaching process. However, as recognized and appreciated by Inventors, without wishing to be bound by any particular theory, when low acid loadings are used, the partial dissolution of the sedimentary resource allows for additional surface area to be created and for diffusion channels to form in order to the Li held within the non-surface layers to also be selectively leached into the leachate. Furthermore, the high concentration of $H^+$ ions from the introduction of the acid may facilitate an ion exchange mechanism, where the $H^+$ ions in the leachate exchange with the Li held withing the sedimentary resource in a selective fashion.

Many suitable acids are known. In some embodiments, the acid is sulfuric acid ($H_2SO_4$). However, any suitable acid may be used. Other non-limiting examples of suitable acids may include, but are not limited to, hydrochloric acid (HCl), hydrobromic acid (HBr), perchloric acid ($HClO_4$), and/or nitric acid ($HNO_3$). Other acids are also possible.

In some embodiments, an acid is present at a particular mass ratio relative to the sedimentary ore. In some embodiments, a mass ratio of acid to sedimentary ore is less than or equal to 1, 0.9, 0.8, 0.7, 0.6, 0.5, 0.4, 0.3, 0.2, or 0.1. In some embodiments, a mass ratio of acid to sedimentary ore is greater than or equal to 0.1, 0.2, 0.3, 0.4, 0.5, 0.6, 0.7, 0.8, 0.9, or 1. Combinations of the foregoing are also contemplated including, for example, a mass ratio of acid to sedimentary ore that is between or equal 0.1 and 1. Other ranges are possible.

In some embodiments, the mass of acid is less than or equal to 0.5 kg, 0.4 kg, 0.3 kg, 0.2 kg, or 0.1 kg per kilogram of sedimentary ore. In some embodiments, the mass of acid is greater than or equal to 0.1 kg, 0.2 kg, or 0.3 kg per kilogram of sedimentary ore. Combinations of the foregoing are also contemplated including, for example, a mass of acid that is between or equal to 0.5 kg and 0.1 kg per kilogram of sedimentary ore. Of course, other ranges are contemplated, as this disclosure is not so limited.

The acid used in the various solutions and systems disclosed herein may be present in solution (e.g., an aqueous solution) at any suitable concentration. In some embodiments, the concentration of acid is less than or equal to 3 M, less than or equal to 2.5 M, less than or equal to 2 M, less than or equal to 1.5 M, less than or equal to 1 M, less than or equal to 0.9 M, less than or equal to 0.8 M, less than or equal to 0.7 M, less than or equal to 0.6 M, less than or equal to 0.5 M, less than or equal to 0.4 M, less than or equal to 0.3 M, less than or equal to 0.2 M, or less than or equal to 0.1 M. In some embodiments, the concentration of acid is greater than or equal to 0.1 M, greater than or equal to 0.2 M, greater than or equal to 0.3 M, greater than or equal to 0.4 M, greater than or equal to 0.5 M, greater than or equal to 0.6 M, greater than or equal to 0.7 M, greater than or equal to 0.8 M, greater than or equal to 0.9 M, greater than or equal to 1 M, greater than or equal to 1.5 M, greater than or equal to 2 M, or greater than or equal to 2.5 M. Combinations of the foregoing are also contemplated, for example, a concentration between or equal to 0.1 M and 3 M. Other ranges are possible.

In some embodiments, a composition or a solution may comprise a combination of one or more acids and/or one or more oxidants. For example, in an exemplary embodiment, the composition comprises sulfuric acid and sodium persulfate. Without wishing to be bound by any particular theory, the combinations of acid and peroxide may form or generate reactive oxygen species within the solution. These reactive oxygen species may enhance the oxidizing power of the oxidant compared to its oxidizing power without the acid. It is believed the combination of acid and peroxide may work synergistically with the dilute acid works to etch the outer layers of the sedimentary ore, which then allows for greater surface area and access for the oxidizing agent to selectively leach the Li held within the sedimentary resource through the this phenomena. Without this synergistic effect, the oxidizing agent may not be effective at interacting with the ionically bonded Li within the sedimentary resource. However, it should be understood that, in other embodiments, the composition or solution may contain either acid or oxidant, but not both.

The compositions, systems, and methods described herein may be suitable for leaching and/or extracting lithium from sedimentary ore. As used in this context, sedimentary ore may encompass sediment, sedimentary rock, sedimentary deposits, clays, claystones, and/or any other similar sedimentary resource that might contain lithium or another desired element. It should be understood that these terms may be used interchangeably within the current disclosure to refer to a sedimentary ore. Sedimentary ores are formed by the accumulation or deposition of particles over time, followed by cementation such that the particles are cemented together to form the sedimentary ore. As a result, in some embodiments, the sedimentary ore may comprise a layered structure. Without wishing to be bound by any particular theory, lithium within sedimentary ore may be less tightly bound (e.g., have a lower lattice energy) compared to lithium within hard rock resources (which may have a higher lattice energy). As mentioned above, sedimentary ores have been particularly underused relative to conventional hard rock and brine resources, but it has been recognized and appreciated by the Inventors that the compositions, systems, and methods described herein may advantageously leach and/or extract lithium from these sedimentary ores. In some embodiments, the acid may be used to etch a surface layer of the sedimentary ore and/or to allow the oxidant to infiltrate the sedimentary ore.

In some embodiments, to facilitate leaching of lithium from the sedimentary ore, the sedimentary ore may be suspended in a composition or a solution containing the oxidant and/or the acid. In some cases, it may be advantageous to grind or mill the sedimentary ore into a plurality of particles of sedimentary ore to increase the exposed surface area of the sediment. Accordingly, certain embodiments may comprise grinding or milling of the sedimentary ore so as to form smaller particles of the sedimentary ore. Techniques for grinding or milling are known to those skilled in the art and may include, but are not limited to, ball milling, disk milling, or planetary gear milling.

The particle size of the sedimentary ore (or particles of the sedimentary ore) may be of any suitable dimension for leaching or extracting lithium. In some embodiments, the particles of sedimentary ore have an average maximum cross-sectional dimension (e.g., an average diameter) of less than or equal to 2 mm, less than or equal to 1 mm, less than or equal to 750 μm, less than or equal to 500 μm, less than or equal to 400 μm, less than or equal to 300 μm, less than or equal to 200 μm, less than or equal to 100 μm, less than or equal to 50 μm, less than or equal to 40 μm, less than or equal to 30 μm, less than or equal to 20 μm, less than or equal to 10 μm, less than or equal to 5 μm, or less than or equal to 1 μm. In some embodiments, the particles of sedimentary ore have a maximum average cross-sectional dimension of greater than or equal to 1 μm, greater than or equal to 5 μm, greater than or equal to 10 μm, greater than or equal to 20 μm, greater than or equal to 30 μm, greater than or equal to 40 μm, greater than or equal to 50 μm, greater than or equal to 100 μm, greater than or equal to 400 μm, greater than or equal to 500 μm, greater than or equal to 750 μm, or greater than or equal to 1 mm. Combinations of the foregoing are also contemplated, for example, a particle size of the sedimentary ore may have a maximum average cross-sectional dimension between or equal to 100 μm and 2 mm. Other ranges are also contemplated as this disclosure is not so limited.

In some embodiments, the acid may be used to etch a surface layer of the sedimentary ore and/or to allow the oxidant to infiltrate the sedimentary ore.

In some embodiments, lithium may be leached and/or extracted. As described in this context, "lithium" may refer to any lithium species present, for example, lithium ions, lithium salts, and/or lithium compounds. For example, in some embodiments, lithium ions are leached and extracted from the sedimentary ore. In some embodiments, the sedimentary ore comprising a lithium species is exposed to a solution comprising an acid and/or an oxidant in order to leach the lithium ions into solution to form a leachate. In some cases, the lithium ions are then extracted and isolated from the leachate as a product (e.g., as a lithium salt). In some embodiments, the isolated lithium product is lithium hydroxide (or a hydrate thereof, such as lithium hydroxide monohydrate). In some such embodiments, the lithium hydroxide is of sufficient purity for battery applications (e.g., a purity of at least 95%, of at least 99%, or any other appropriate purity), such as in a secondary lithium-ion battery.

As mentioned elsewhere herein, the compositions, systems, and method may selectively leach lithium into the leachate in a greater proportion relative to the original composition of the sedimentary ore as compared to other species present in the sedimentary ore including, for example, other cationic or metallic species (e.g., Mg, Ca, Mn, Si, K, Al, Fe). In some embodiments, the selectivity of lithium over other metals in the solution or in the leachate is greater than or equal to 5:1, 10:1, 15:1, 20:1, 30:1, 40:1, 50:1, or 60:1. The selectivity can be defined as the ratio (e.g., molar ratio) of lithium relative to the other chemical species extracted from the sedimentary ore. As a hypothetical example, if 60 millimoles of lithium was leached from a sedimentary ore while 1 millimole of magnesium was leached from the same sedimentary ore, then the selectivity of lithium over magnesium would be 60:1. The amount of a species (e.g., lithium, other metal species) in solution may be measured using inductively coupled plasma optical emission spectrometry (ICP-OES).

In some embodiments, lithium or other chemical species is leached into a solution or a suspension to form a leachate. Leachate is given its ordinary meaning in the art to describe a liquid (e.g., water, an aqueous solution) that leached one or more constituents from a solid. In some embodiments, the liquid is or comprises water, such that the leachate is an aqueous solution, suspension, or slurry. However, this disclosure is not so limited, and any suitable liquid may be used.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 1B:
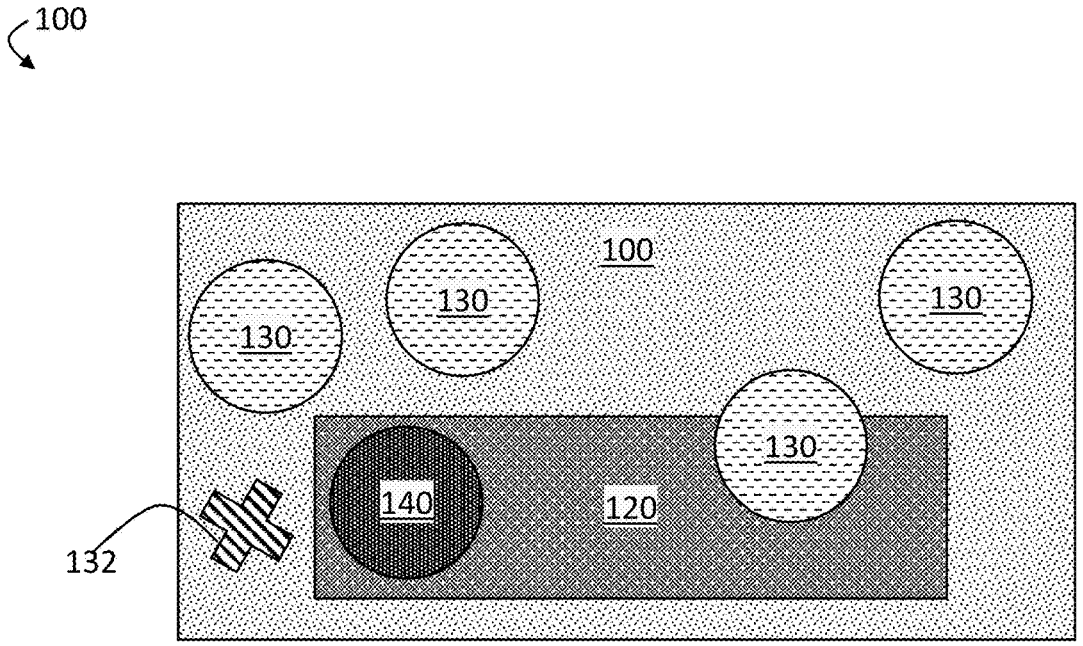

FIG. 1A and FIG. 1B show schematic side views of a composition for leaching a chemical species, such as lithium, into a solution. In FIG. 1A, a vessel 100 contains a composition 110 for leaching lithium species 130 from a sedimentary ore 120. The composition may comprise an oxidant and an acid, which may be used to extract lithium (or another chemical species) within the sedimentary ore such that lithium is selectively dissolved into the composition over at least one other chemical species within the sedimentary ore. The sedimentary ore may contain lithium species within, adsorbed on, or absorbed on the sedimentary, and the composition can liberate the lithium species from the sedimentary ore. In some cases, a mixer 132 is present within the vessel 100 to provide agitation or otherwise mix the sedimentary ore with the components of the composition. The mixer can be disposed within the vessel, the composition, or a chamber in any suitable position so as to provide mixing of the various components contained therein. While a single piece of the sedimentary ore is illustrated in the figure, it should be understood that a plurality of particles of the sedimentary ore may either be disposed in, suspended in, or otherwise exposed to the acid and/or oxidizer of the solution. Thus, it should be understood that the figures are provided for illustrative purposes only, and the disclosure is not limited to the specific illustrative embodiments shown in the figures.

As noted above, the action of the composition on the sedimentary ore may liberate lithium species from the sedimentary ore. For example, as shown schematically in FIG. 1B, lithium species 130 have been leached from sedimentary ore 120. However, it should be noted, that some chemical species may not be leached into the composition. By way of example, non-lithium chemical species 140 may remain within the sedimentary ore 120, while lithium species 130 is leached into composition 110. Hence the leaching process may be selective for lithium species 130 relative to the depicted non-lithium chemical species 140.

Figure 1C:
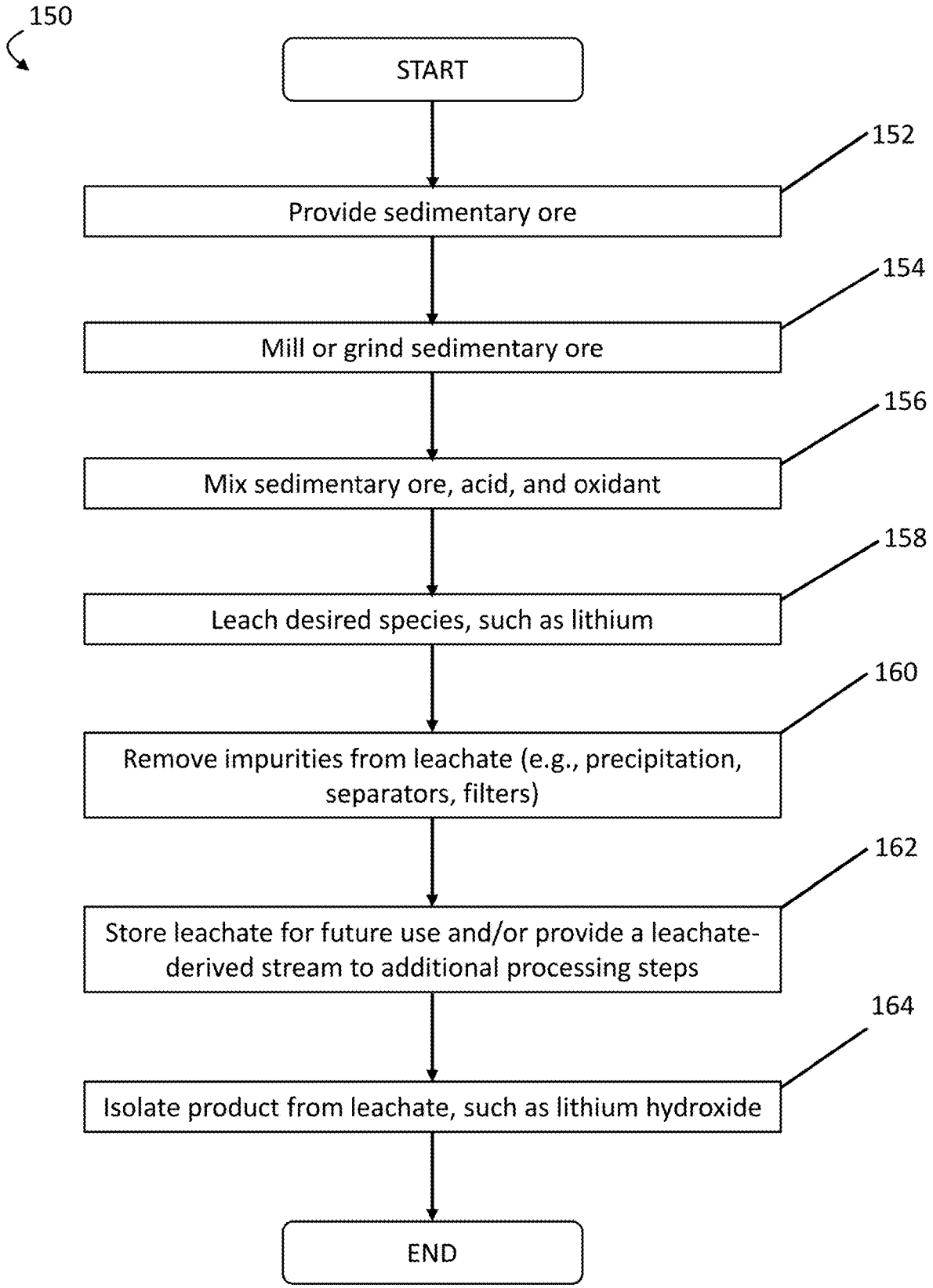
FIG. 1C is a process diagram for a selective leaching and extracting process, according to some embodiments.

FIG. 1C shows a process diagram illustrating an exemplary process 150 for leaching a chemical species (e.g., lithium) from a sedimentary ore. The diagram also describes subsequent steps for extracting the chemical species from a solution containing the leached chemical species (i.e., from the leachate). The process begins with step 152, by providing sedimentary ore. In some embodiments, the sedimentary ore is provided by a sedimentary ore source such as a feeder, hopper, conveyor belt, or other appropriate source capable of transporting the sedimentary ore to a processing system. In some cases, the sedimentary ore is ground or milled to form a plurality of particles comprising the sedimentary ore (step 154) so as to increase the surface area of the sedimentary ore exposed to the composition. Next, in step 156, the sedimentary ore, the oxidant, and acid are mixed to facilitate contact of the sedimentary ore with the composition included in the solution. In some instances, mixing these components may include forming a solution with the particles suspended therein. However, instances in which the solution flows across, or percolates through, the sedimentary ore are also contemplated. In step 158, the desired lithium species are leached into the composition to form a leachate as previously described.

The leachate may undergo one or more processing steps in order to extract lithium from the leachate which are expanded on further below in relation to the other figures. For example, step 160 may comprise removing impurities or contaminants from the leachate. In some embodiments, the impurities may comprise undesired cationic species (e.g., metal ions, Ca, Mg, Al). In step 162, the leachate is stored and/or portions of the leachate may be processed and provided to other portions of the system. For example, in some embodiments, lithium from the leachate may be used to form a basic solution comprising lithium hydroxide, which may be used upstream to aid in removing impurities from unprocessed leachate (e.g., by precipitating undesired metal ions, such as calcium, magnesium, iron, or aluminum from the leachate). In some cases, the leachate is processed so as to remove or isolate a product from the leachate (step 164), such as lithium hydroxide in solid form (contrasted with lithium hydroxide dissolve in solution).

Additional, non-limiting details regarding extracting lithium (or another chemical species) from a leachate are provided below. While these details are described in the context of the figures, it should be understood that the various systems, components, features, and methods described relative to these embodiments may be used either individually and/or in any desired combination as the disclosure is not limited to only the specific embodiments described below.

In some embodiments, electrodialysis may be used to extract lithium from a leachate. As used in this context, electrodialysis is given its ordinary meaning to describe the transport of ions from one solution, through an ion-exchange membrane, to another solution under the influence of an applied voltage differential.

Figure 2A:
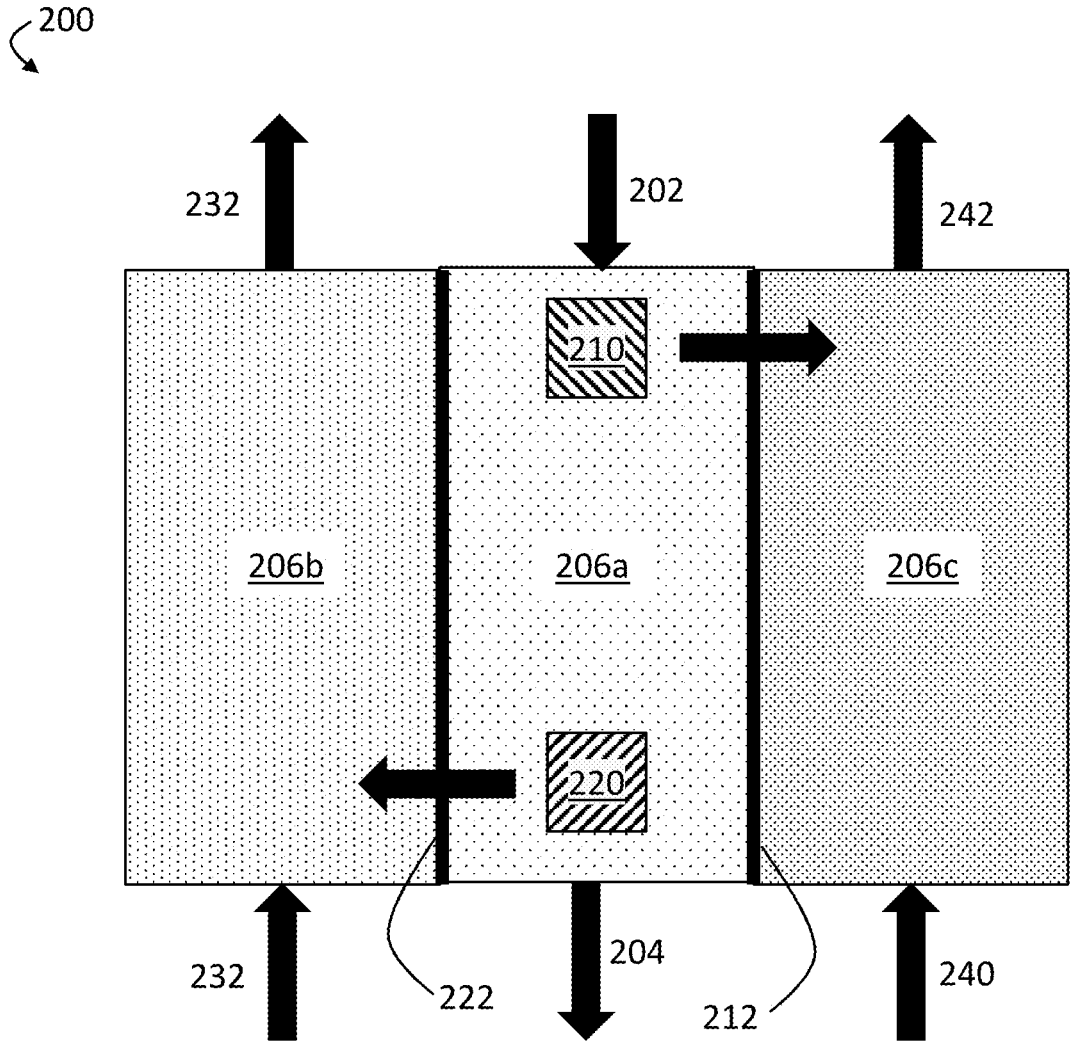
FIG. 2A is an illustrative schematic of an electrodialysis stack for extracting a species, such as lithium, from a leachate, according to some embodiments.

FIG. 2A shows a schematic illustration of an electrodialysis stack comprising multiple electrodialysis cells arranged adjacent to one another. In the figure, electrodialysis stack 200 is configured to receive a stream of the leachate from a first inlet 202 of the stack. The stream of the leachate (e.g., a depleted leachate) flows through a first internal volume 206*a* of the stack disposed between a first membrane 212 and a second membrane 222 prior to flowing through a first outlet 204 of the stack. The electrodialysis cells are separated within the electrodialysis stack 200 by the first membrane 212 and the second membrane 222. As the leachate enters the electrodialysis stack 200 through inlet 202, a first species within the leachate, such as cation 210, may diffuse across the first membrane 212. The movement of the cation across the membrane may be the result of an applied first voltage (not shown). Similarly, a second species within the leachate, such as anion 220, may diffuse across the second membrane 220 under the influence of an applied second voltage. In this manner, species within the leachate (e.g., lithium ions, sulfate ions) can be removed, and, in some embodiments, further processed. It is noted that while not shown in the figure, the electrodialysis stack may have more than two membranes.

In some embodiments, each cell of the electrodialysis stack may correspond to a separate volume that may be in fluid communication with a separate inlet and outlet associated with that particular cell of the electrodialysis stack. For example, in FIG. 2A, a second volume 206*b* of the electrodialysis stack 200 is in fluid communication with a second inlet 232 and a second outlet 232. The inlet may be configured to deliver a stream containing a liquid, such as water, to transport anions 220 which have diffused across the corresponding ion exchange membrane 222 from the leachate flowing through the first volume of the electrodialysis stack 200. This steam may flow to another chamber or portion of the system via outlet 232. Similarly, a third volume 206*c* of the electrodialysis stack 200 may be in fluid communication with a third inlet 240 and a third outlet 242, whereby the inlet 240 is configured to flow a stream of liquid, such as water, through the third volume to transport cations 210 which have diffused across the corresponding ion exchange membrane 212 of the electrodialysis stack 200. The stream may then flow to another chamber of portion of the system via outlet 242. Thus, the connections and possible uses of the streams flowing out from the depicted outlets of each volume are elaborated on further below.

As noted above, in some embodiments, the electrodialysis stack may comprise one or more membranes, which may be used to define electrodialysis cells within the stack. In some embodiments, the membrane comprises an ion-exchange membrane. As used in this context, an ion-exchange membrane describes a semi-permeable membrane that permits the transport of certain dissolved ions across the membrane, while blocking certain other dissolved ions or neutral species. In some cases, the ion-exchange membrane is a cation exchange membrane (CEM), while in some cases, the ion-exchange membrane is an anion exchange membrane (AEM). In some embodiments, the electrodialysis stack contains one or more cation exchange membranes and one or more anion exchange membranes so that both cations and anions may be exchanged based on the needs and desires of the system and/or the user. Those skilled in the art based on the teachings of the present disclosure will be capable of selecting the appropriate ion-exchange membrane, alone or in combination, for extracting one or more desired chemical species.

In some embodiments, an electrodialysis stack also comprises a bipolar membrane (BPM). In some cases, the bipolar membrane is configured to "split" water, converting a molecule of $H_2O$ into $H^+$ and $OH^-$. In some such cases, the BPM may be coupled with a CEM and an AEM such that a salt (e.g., lithium sulfate) and water may be converted into an aqueous acid (e.g., $H_2SO_4$) and base (e.g., LiOH). In some such embodiments, the acid and/or base are relatively dilute as compared to typical leaching and extraction processes (e.g., less than 3 M, less than 1.5 M, less than 1 M), which may advantageously avoid corrosive damage to the membranes within the electrodialysis stack or other membranes within the system.

As mentioned above, the leachate may comprise a first species, which may be a cationic species. In some embodiments, the first species comprises lithium ions from the leachate, and the electrodialysis stack may be used to separate lithium ions from other ions of the leachate by diffusing the lithium across a cation exchange membrane. In some such embodiments, the lithium ion is exchanged for a hydrogen ion (i.e., a proton, $H^+$, $H_3O^+$), for example, when coupled with a water-splitting BPM. And while the first species may comprise lithium ions, it should be understood that other cations are possible, as this disclosure is not so limited In some embodiments, the flow of the lithium ions across the CEM may mix with hydroxide ions flowing through the AEM resulting in the formation of a basic solution. The concomitant increase in the concentration of hydroxide ions may make the solution more basic over time. Advantageously, in some embodiments, this may be used as a hydroxide source or "base source," in which the basic solution produced may be used further upstream, for example, for treating the leachate to remove contaminants that participate in a basic solution (e.g., Ca, Mg, Fe, Al). In one such embodiment, this may comprise flowing the basic solution from the electrodialysis stack to a second chamber, and the second chamber may contain a leachate comprising contaminants that can be removed by the addition of a base. However, in some embodiments, the basic solution may comprise a product to be isolated, and a chamber may be configured to isolate the product, which is described in more detail elsewhere herein.

In some embodiments, a second species is removed from the leachate. In some cases, the second species is an anionic species. In an exemplary embodiment, the anionic species is a sulfate ion, or a salt thereof. In some such embodiments, the second membrane is an AEM, and the sulfate ion may be exchanged for a hydroxide ion by also using a BPM coupled with the AEM. However, other anions are possible, including any counter-ion from acid addition in upstream operations, such as chloride or fluoride anions, as this disclosure is not so limited.

In some embodiments, the flow of sulfate ions (or some other anion) across the second membrane may result in the formation of an acidic solution. For example, when coupled with a BPM, the sulfate ions crossing the AEM may mix with hydrogen cations crossing the CEM, and the pH of an incoming flow of a liquid (e.g., water) may decrease with a concomitant increase in the concentration of hydrogen ions within the stream, which now also contains the sulfate ions. Advantageously, this acidic stream may be used as an "acid source," in which the acidic solution produced may be used further upstream, for example, for treating sedimentary ore in the presence of an oxidant in order to leach a chemical species (e.g., lithium) from the sedimentary ore. In one such embodiment, this may comprise flowing the acidic solution from the electrodialysis stack to a first chamber which may include a sedimentary ore disposed therein such that the acidic solution may facilitate leaching of the first species from the sedimentary ore along with the oxidant.

As another advantage, the produced acid stream may be relatively dilute (e.g., less than 3 M, less than 1.5 M, less than 1 M) when compared to acid streams used to treat conventional lithium resources. This relatively dilute stream may allow the use of acidic streams within the electrodialysis stack, or elsewhere within the system, without damaging components of the stack or the system. By contrast, many acidic streams used to treat conventional lithium resources use highly concentrated acids (e.g., greater than 3 M) that would not be compatible with membranes of an electrodialysis stack. However, as recognized and appreciated within this disclosure, sedimentary lithium resources can be processed using relatively dilute streams of acid, and the systems and methods described herein may be used to recycle dilute acidic solutions for further processing of lithium sedimentary deposits, such as for recycling within a composition also comprising an oxidant. This may result a more efficient process with reduced production of waste as compared to typical processes.

A liquid may be used to collect the first species (e.g., lithium ions) and/or the second species (e.g., sulfate ions) described above. In an exemplary embodiment, the liquid is water, such that the solutions formed by either the first species or the second species are aqueous solutions. However, any suitable solvent for the first species and/or the second species may be used.

After removing the first species and/or the second species from a leachate, the "depleted" leachate may have a concentration of one or more species (e.g., lithium ions, sulfate ions) that is less than a concentration of the one or more species prior to removal. That is to say, the leachate entering the electrodialysis stack may have a higher concentration of one or more species relative to the depleted leachate exiting the electrodialysis stack. By way of example, in FIG. 2A, the leachate may enter the electrodialysis stack 200 via inlet 202 into the first volume 206*a* with a first concentration of one or more species, and may exit outlet 204 as a depleted leachate with a second concentration of the one or more species, wherein the second concentration of the depleted leachate is less than the first concentration of the leachate.

The depleted leachate may still contain at least some of the first species and/or the second species. In some embodiments, the depleted leachate may be further processed and/or recycled. For example, the depleted leachate may be flowed to one or more chambers further upstream. In some embodiments, the depleted leachate may be flowed to a vessel or a chamber comprising sedimentary ore and may be used to further leach a species (e.g., the first species, lithium ions) from the sedimentary ore. In some such embodiments, the depleted leachate may be combined with oxidant and/or acid in order to leach additional lithium from the sedimentary ore. In some embodiments, the depleted leachate is flowed back to the electrodialysis stack so that additional amounts of the first species and/or the second species may be extracted from the depleted leachate.

The system for extracting lithium may include one or more additional chambers in upstream or downstream positions relative to the electrodialysis stack. Examples of additional chambers are described in more detail below in relation to FIG. 2B. However, it should be understood that any suitable number of chambers may be included within the system for extracting lithium, as this disclosure is not so limited. In addition, the various configurations are not exclusive to a particular chamber numbering and any one of the chambers can contain one or more configurations or function. In some embodiments, the chamber is a vessel or a reactor (e.g., a continuous flow tank reactor). In some embodiments, the chamber may be configured to perform one or more processes, such as lithium pretreatment, nanofiltration, concentration (e.g., reverse osmosis concentration), polishing (removal of trace amounts of metal contaminants from the solution), and/or crystallization. Other processes are possible. The chambers may be fluidically connected using inlets and outlets are described below. The inlets and outlets may be any suitable conduits, tubing, or other appropriate connections that permit the various inlets and outlets of the various components of a system to be placed in fluid communication with one another. In some embodiments, an outlet from one chamber may act as an inlet to one or more other chambers, such that an output stream from one chamber may flow into one or more other chambers.

Figure 2B:
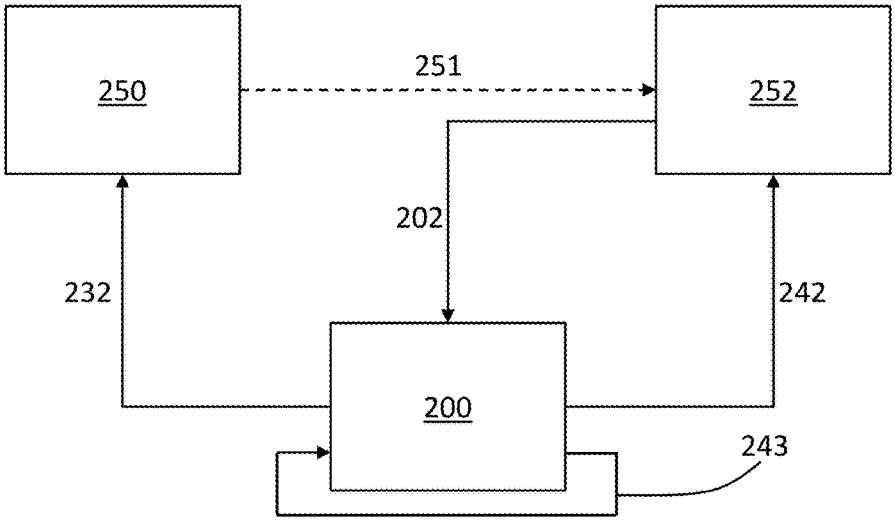
FIGS. 2B-2C are schematic diagrams of systems for extracting a species, such as lithium, from a leachate and using acidic and/or basic streams from one portion of the system in other portions of the system, according to some embodiments.

Returning to the figures, a non-limiting embodiment of a system for extracting a chemical species from a solid is described. FIG. 2B shows a schematic diagram of a system for extracting lithium from sedimentary ore. The system includes an electrodialysis stack 200, which may be similar to the stack described above, a first chamber 250, and a second chamber 252. The first chamber may be in fluid communication with an associated first outlet of the electrodialysis stack 200 such that a first output stream 232 may flow from the electrodialysis chamber to the first chamber 250. The second chamber 252 may be in fluid communication with a separate outlet of the electrodialysis stack such that a second output stream 242 may flow from a second outlet of the electrodialysis stack to the second chamber. Such a configuration may allow for output streams from the electrodialysis stack to act as input streams or sources to other portions of the system (such as upstream or downstream chambers), which may lead to a number of advantages as described elsewhere herein.

Figure 2C:
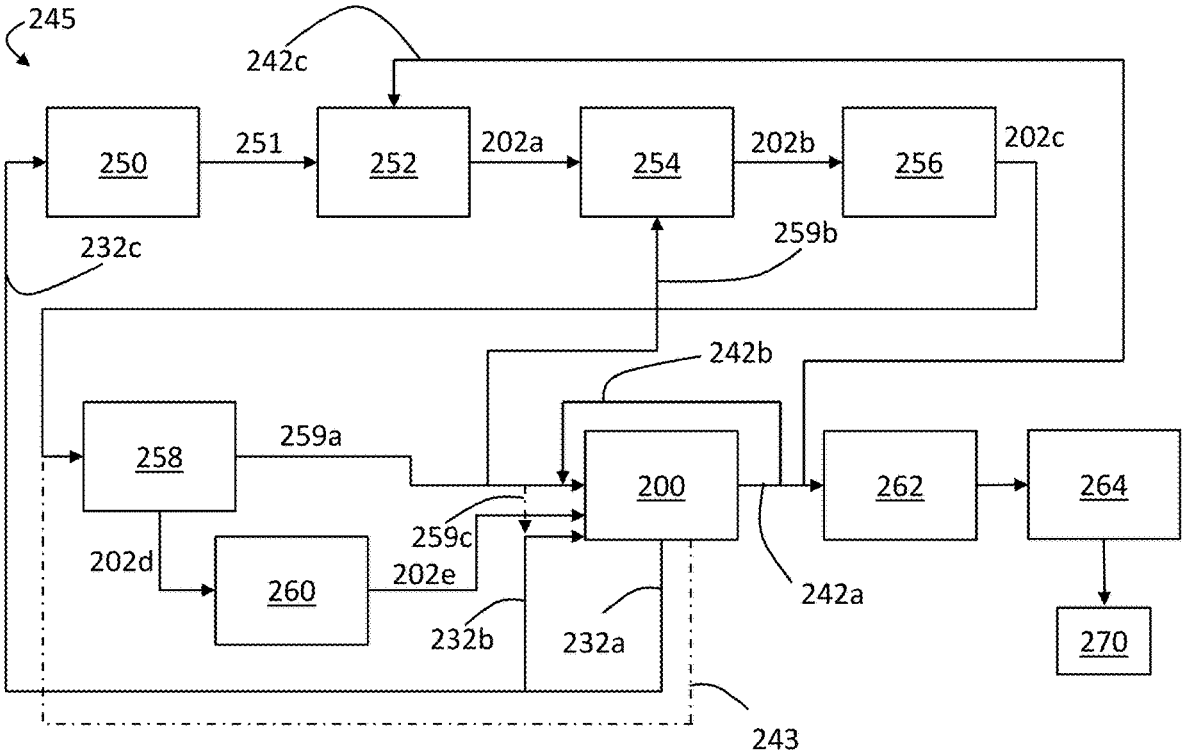

In one exemplary embodiment, the first chamber 250 may contain sedimentary ore and a composition containing an oxidant and/or acid. The electrodialysis stack 200 may flow the first output stream 232, which may be an acidic solution (e.g., a dilute acidic solution), to the first chamber 250, where it may be used to leach (or help leach) lithium from the sedimentary ore. The first chamber and the second chamber may also be fluidic communication such that leachate 251 may flow from the first chamber to the second chamber via any appropriate connection extending between the two chambers. However, it should be understood that one or more additional chambers may be disposed along a flow path extending between the first chamber 250 and the second chamber 252. One such configuration is schematically illustrated in FIG. 2C, which is described further below. In some embodiments, the second output stream 242 that flows from the electrodialysis stack to the to the second chamber 252 comprises a basic solution (e.g., a dilute basic solution). As mentioned elsewhere herein, in some embodiments, the basic solution may be used to process the leachate by precipitating contaminants from the leachate. The second chamber 252 may be in fluid communication with the electrodialysis stack such that the processed leachate 202 may flow downstream from the second chamber to the electrodialysis stack. The leachate flowing into the electrodialysis stack 200 and the other various flows described above in the system may provide a processing cycle for continuously leaching lithium from sedimentary ore and extracting the lithium from the resulting leachate.

In some embodiments, it may be desirable to flow at least a portion of an output stream from the electrodialysis stack into a corresponding inlet of the electrodialysis stack to provide a desired flow of liquid through that portion of the electrodialysis stack 200. For example, a portion of the first and/or second streams 232 and 242 may flow into a corresponding separate inlet of the electrodialysis stack to form a portion of the liquid flowing into the electrodialysis stacks for transporting the ions removed from the leachate, not depicted. Additionally, or alternatively, the system may also include a flow path connecting an inlet and outlet associated with the flow of leachate through the electrodialysis stack such that a third output stream 243 corresponding to a flow of depleted leachate may be combined with a flow of fresh leachate that flows into the electrodialysis stack. In view of the above, it should be understood that a portion of any stream output from the electrodialysis stack may either flow into an upstream portion of the process and/or flow into a corresponding inlet of the electrodialysis stack to be recycled and/or provide a desired composition of the one or more liquid streams flowing into the electrodialysis stack. S As noted above, the disclosed system may comprise one or more additional chambers in upstream and/or downstream positions from the electrodialysis stack. One such embodiment is shown in FIG. 2C which depicts a system 245 for extracting lithium from sedimentary ore. Similar to the above, the first chamber 250 is configured to contain a composition for leaching lithium from sedimentary ore which may include an oxidant and an acid. Lithium ions may be dissolved into solution and flow into second chamber 252 in the form of a leachate 251. In some embodiments, second chamber 252 is configured for lithium pretreatment. Lithium pretreatment may comprise adjusting the pH of the solution from an acidic pH towards a basic pH so as to precipitate metal contaminants that form insoluble salts in the basic solution (e.g., Ca, Mg, Fe, Al). In some embodiments, the second chamber 252 is configured to receive a basic solution from a basic solution source, which in the depicted embodiment, may correspond to an outlet stream from one or more downstream chambers, though other appropriate basic solution sources may also be used. For example, the second output stream 242*a* of electrodialysis stack 200 may include a portion 242*b* that flows to an inlet of the second chamber 252 used to pretreat the leachate.

The pretreated leachate 202*a* corresponding to the lithium-containing basic solution in the second chamber 252 may flow into a third chamber 254 that is in fluid communication with the second chamber. In some embodiments, the third chamber comprises a lithium-selective sorbent disposed therein that can selectively remove lithium ions from solution prior to the remaining waste liquid flowing out of the chamber through a waste outlet, not depicted. Non-limiting examples of lithium-selective sorbents include, but are not limited to, layered aluminum hydroxide, $H_2TiO_3$, $H_2Ti_4O_5$, $H_2Mn_2O_4$, and/or any other appropriate lithium-selective sorbent. In some embodiments, the lithium-selective sorbent is configured such that lithium ions may be released from the sorbent using water (e.g. deionized water, dilute $Li_2SO_4$ solution), or other appropriate liquid, that flows into the third chamber from a fluidly connected water source such that it comes into contact with the sorbent to release the lithium species into the liquid to form a lithium containing solution, e.g. a purified leachate. In some such embodiments, the lithium ions can be released from the sorbent as a sulfate salt (i.e., lithium sulfate dissolved in water).

The lithium-containing solution 202*b* may then flow from the third chamber 254 into a fourth chamber 256 that is in fluid communication with the third chamber. In some embodiments, the fourth chamber is a filter where a filter, such as a nano-filter, is disposed along a flow path of the solution flowing through the fourth chamber. In some embodiments, the nano-filter may remove various multivalent cations from the solution such that only monovalent cations (e.g., lithium cations) proceed further downstream. In some embodiments, the nanofiltration system may comprise a membrane configured to reject multivalent ions while permitting the flow of monovalent ions across the membrane. Non-limiting of membranes may include DuPont® Fortilife SR90 and/or any other appropriate type of membrane. Additionally, it should be understood that other types of filters and/or systems in which filters are not used are also contemplated as the disclosure is not so limited.

A flow of the lithium-containing solution 202*c* may then flow from the fourth chamber 256 to a fifth chamber 258 that is in fluid communication with the fourth chamber. In some embodiments, the fifth chamber comprises a concentrator. In some embodiments, the concentrator comprises a reverse osmosis system, which may be used to concentrate the lithium-containing solution by separating a portion of the water contained into the solution such that a flow of deionized solution 259*a* (e.g., deionized water) and a concentrated lithium containing solution 202*d* may be output from the concentrator. In some embodiments, the fifth chamber is configured such that an outlet of the concentrator through which the deionized solution flows is in fluid communication with one or more inlets of the electrodialysis stack 200. In some embodiments, at least a portion of the water 259*b* may flow into the third chamber to facilitate the lithium extraction process such that the concentrator functions as a water source for the third chamber 254.

Depending on the embodiment, the concentrated lithium-containing solution may flow from the fifth chamber 258 to a sixth chamber 260 in fluid communication with an outlet of the fifth chamber through which the concentrated lithium-containing solution flows. In some embodiments the sixth chamber comprises a fixed bed reactor containing chelating resins, or other appropriate materials, that can remove residual amounts of contaminants from the solution as it flows through the bed reactor. In some embodiments, the chelating resin contains moieties to bind cations, such as heavy metal ions, which can bind these cations and remove them from the solution as the leachate, corresponding to the concentrated lithium-containing solution, is flowed over the resin. Non-limiting examples of chelating resins may include, but are not limited to, DuPont® chelating resin 747.

From the sixth chamber 260, the lithium-containing solution 202*e* may flow into the electrodialysis 200. As described elsewhere herein, the lithium-containing solution may flow past one or more ion-exchange membranes and/or bipolar membranes while a voltage differential is applied to the electrodialysis stack to pair the lithium ions within the solution with a desired counterion. In some embodiments, the lithium-containing solution comprises lithium sulfate, and the electrodialysis stack is configured to separate the lithium ions from the sulfate ions while, in some embodiments, also separating water into hydroxide ions and $H^+$ ions (protons), so as to form lithium hydroxide, along with $HSO_4^-$ and/or $H_2SO_4$. As elaborated on above, the sulfate ions and lithium ions may diffuse across different membranes within the electrodialysis stack to form three separate streams that are output from the electrodialysis stack including: a sulfate containing, or acidic, stream 232*a*; a depleted leachate stream 243; and a lithium hydroxide containing, or basic, stream 242*a*.

The sulfate-containing stream 232*a* may act as an acid source for other chambers within the system. For example, an outlet of the electrodialysis stack 200 through which the sulfate stream 232*a* flows may be in fluid communication with an inlet of a cell of the electrodialysis stack corresponding to the sulfate flow via flow path 232*b* such that a portion of the sulfate stream is recycled back into the electrodialysis stack along with a portion of the water 259 from the fifth chamber 258 (i.e. the concentrator) or another appropriate water source. The water may help to dilute the acidic stream to a predetermined concentration for operation of the electrodialysis stack. In some embodiments, a portion of the acidic stream 232*a* output from the electrodialysis stack may also flow into the first chamber 250 to facilitate a leaching process as described above.

Similar to the acidic stream, the lithium hydroxide containing, or basic, stream 242*a* may be used as a base source for other chambers within the system, and/or it may be isolated as a product downstream from the electrodialysis stack 200. For example, in some cases, the basic stream can be recycled back into the electrodialysis stack 200 via a recycled basic stream 242*b* where a portion of the output basic stream flows from an outlet of the electrodialysis stack for the basic stream to an inlet of the electrodialysis stack associated with the basic stream. The portion of the output basic stream may be diluted using at least a portion of the water 259*c* output from the fifth chamber 258. This may provide a predetermined concentration of the basic solution for inputting to the electrodialysis stack during operation, as shown in FIG. 2C. As noted previously, another portion of the basic stream 242*c* may flow into the second chamber 252 to pretreat a leachate from the first chamber.

To help improve an overall efficiency of an extraction process, in some embodiments, the depleted leachate stream 243 may be recycled into the process as described previously above. In the depicted embodiment, an outlet of the electrodialysis stack 200 is in fluid communication with the fifth chamber 258 (i.e. the concentrator) such that the depleted leachate flows from the electrodialysis chamber into the concentrator. The depleted leachate may be combined with fresh leachate flowing into the concentrator prior to flowing into the concentrator and/or within the concentrator itself. Thus, the depleted leachate may be recycled into the flow of materials passing through the system which may allow an increased fraction of the lithium to be extracted from the leachate as compared to typical processes.

In some embodiments, a product is isolated after extracting the lithium in a desired form from a leachate. For example, in the illustrated process, a lithium containing compound corresponding to lithium hydroxide is formed, and it is this compound that may be isolated. By way of example, at least a portion of a lithium-containing basic solution 242*a* may exit the electrodialysis stack 200 and flow into a seventh chamber 262 that is in fluid communication with an outlet of the electrodialysis chamber through which the basic solution flows. In some embodiments, the seventh chamber comprises a crystallizer, such as a vacuum crystallizer, which can be used to isolate a solid product from solution. For example, a product 270 may be isolated from the seventh chamber 262 in FIG. 2C. In some embodiments, the isolated material may be subjected to additional filtration and/or drying processes using the depicted filtration and drying system 264. In some embodiments, the isolated product is battery grade (e.g., >95% purity, >99% purity) lithium hydroxide. In some such embodiments, the lithium hydroxide is a hydrate (e.g., lithium hydroxide monohydrate).

Figure 3:
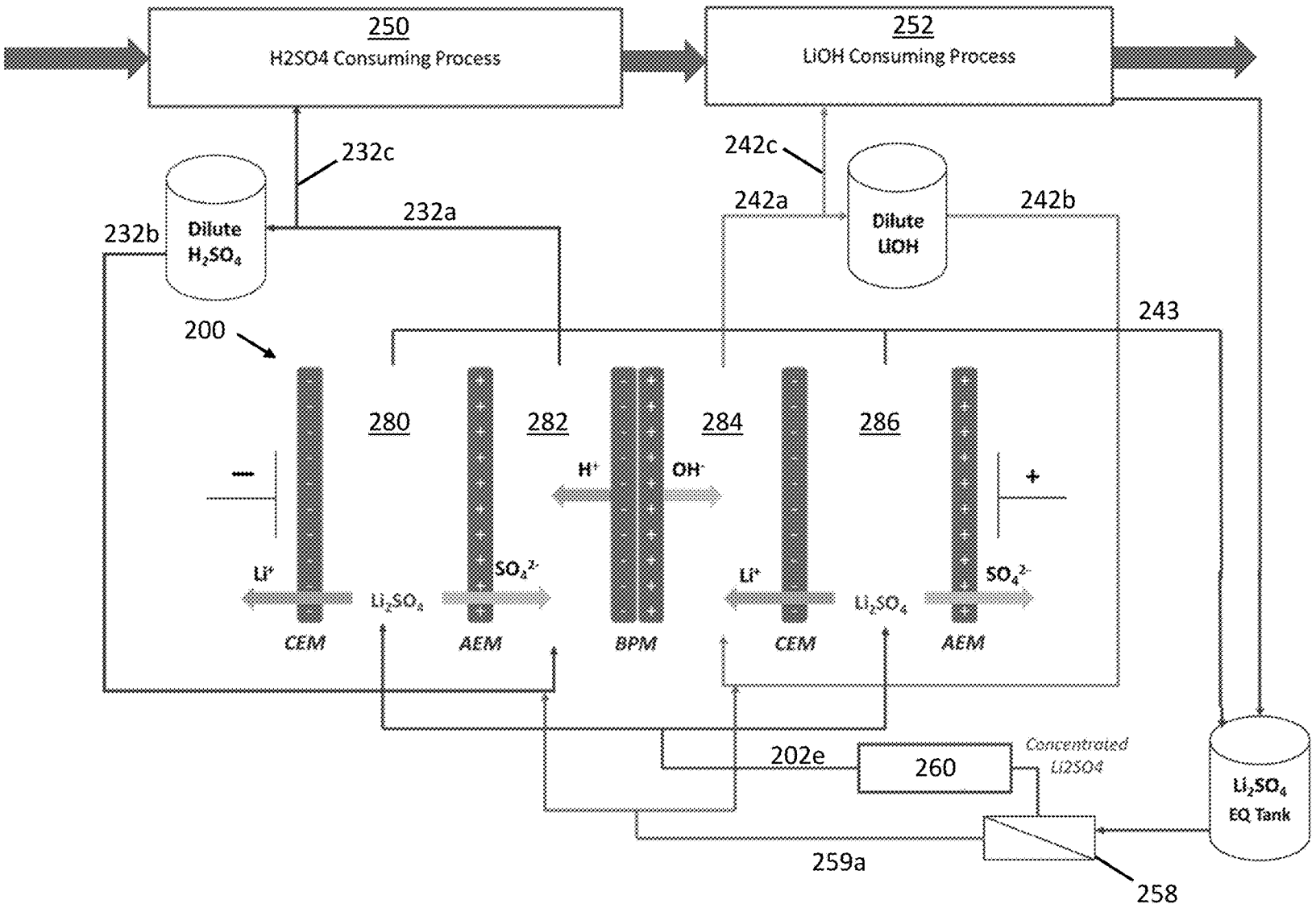
FIG. 3 is a schematic diagram of a system for extracting lithium that uses a combination of cation exchange membranes (CEMs), anion exchange membranes (AEMs), and a bipolar membrane (BPM) to provide dilute $H_2SO_4$ and LiOH to portions of the systems, according to one set of embodiments.

FIG. 3 illustrates a system similar to that described above for FIG. 2A where an acid-consuming process is conducted in the first chamber 250 (e.g. leaching) and a base-consuming process (e.g. pretreatment) is conducted in the second chamber. The flows of various streams into and out of the electrodialysis stack 200 are also illustrated with portions of the flows out of the stack being used in the acid- and base-consuming processes as well as being recycled into the electrodialysis stack itself as described above. In the depicted embodiment, the flow of a leachate such as the concentrated and polished lithium-containing solution 202*e* may flow into one or more salt chambers 280 and 286 of the electrodialysis stack which may be exposed to corresponding cation and anion membranes (AEM and CEM). The leachate may flow through the one or more salt chambers while lithium and sulfate ions, or other appropriate ions, are extracted from the leachate under the voltage differential applied by the depicted electrodes to form a depleted leachate 243 that flows out from the one or more salt chambers and may be used as previously described. Similarly, a basic stream 242*b* and dilution water 259*a* from any appropriate water source may flow into one or more catholyte chambers 284 which may be exposed to corresponding one or more cation membranes and bipolar membranes (BPM). As the solution flows through the catholyte chamber lithium ions and hydroxide ions may combine to form lithium hydroxide which is output as the basic stream 242*a* which may have a higher concentration of lithium hydroxide than the stream input into the catholyte chamber. Lastly, at least a portion 232*b* of an acid stream output from one or more analyte chambers 282 of the electrodialysis stack may flow back into an inlet of the analyte chambers along with dilution water 259*a* from any appropriate water source to provide a predetermined concentration of the acid input into the analyte chamber. Within the analyte chamber hydrogen ions and sulfate ions may combine to form sulfuric acid where the output acid stream 232 has a greater concentration of the acid as compared to the diluted stream of acid input into the one or more analyte chambers. Of course while specific leachate, acid, and basic chemistries are described above, other possible chemistries are also contemplated.

In the above embodiments, various chambers and other components have been described as being in fluid communication with one another. It should be understood that fluid communication may include any appropriate connection such that a liquid is capable of flowing from an outlet of one chamber or component to an associated inlet of another chamber or component. This may be accomplished in any appropriate fashion including, but not limited to, conduits, tubing, direct connections, open channels, pumps, and/or any other appropriate type of fluid connection as the disclosure is not limited in this fashion.

As mentioned elsewhere herein, the compositions, systems, and methods described herein offer several advantages over conventional systems and methods for leaching and/or extracting lithium. Obtaining lithium from sedimentary resources has conventionally been a challenge; however, the compositions, systems, and methods described herein may be used to extract lithium from this underused resource. Furthermore, leaching and extracting lithium from sedimentary resources requires much less acid when compared to extracting lithium from hard rock deposits. In addition, the Inventors have recognized and appreciated that using an oxidant along with an acid (e.g., sulfuric acid) also decreases the amount of acid needed to leach lithium from sedimentary resources in comparison to hard rock resources. As another advantage, leaching from sedimentary ore using the embodiments described herein can be selective for lithium ions over other metal cations within the sedimentary ore. As yet another advantage still, the use of an electrodialysis stack in the lithium extraction process allows acidic streams, basic streams, and/or depleted leachate to be recycled within the system. The disclosed system may also offer advantages by using acidic and basic solutions, in some cases, in dilute concentrations (e.g., less than 3 M, less than 1.5 M, less than 1 M) that do not damage the membranes within the electrodialysis stack or any other components of the extraction system.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize or be able to ascertain using no more than routine experimentation, many equivalents to the specific embodiments of the disclosure. It is, therefore, to be understood that the foregoing embodiments are presented by way of example only and that, within the scope of the appended claims and equivalents thereto, the invention may be practiced otherwise than as specifically described and claimed. The present disclosure is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Some embodiments may be embodied as a method, of which various examples have been described. The acts performed as part of the methods may be ordered in any suitable way. Accordingly, embodiments may be constructed in which acts are performed in an order different than illustrated, which may include different (e.g., more or less) acts than those that are described, and/or that may involve performing some acts simultaneously, even though the acts are shown as being performed sequentially in the embodiments specifically described above.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method of leaching lithium into a solution, the method comprising:

exposing sedimentary ore comprising a lithium species to an acid and an oxidant, wherein the ore and the oxidant are in a solid state;

percolating a liquid through the solid ore and the solid oxidant; and dissolving at least a portion of the lithium species into the liquid to form a leachate.

2. The method of claim 1, further comprising suspending the sedimentary ore in a solution comprising the acid and/or the oxidant.

3. The method of claim 1, further comprising forming reactive oxygen species within the solution.

4. The method of claim 1, further comprising flowing the leachate to one or more chambers or an electrodialysis stack.

5. The method of claim 1, wherein dissolving at least a portion of the lithium species comprises selectively dissolving the lithium species.

6. The method of claim 1, further comprising grinding or milling the sedimentary ore.

7. The method of claim 1, further comprising grinding the sedimentary ore into particles of the sedimentary ore.

8. The method of claim 1, further comprising suspending the sedimentary ore in the solution.

9. The method of claim 1, further comprising using the acid to etch a surface layer of the sedimentary ore and/or allowing the oxidant to infiltrate the sedimentary ore.

10. A method of leaching lithium into a solution, the method comprising:

exposing sedimentary ore comprising a lithium species to an acid and an oxidant, wherein the oxidant is sodium persulfate;

flowing a liquid across the sedimentary ore, the acid, and/or the oxidant; and dissolving at least a portion of the lithium species into the liquid to form a leachate.

11. The method of claim 10, further comprising suspending the sedimentary ore in a solution comprising the acid and/or the oxidant.

12. The method of claim 10, further comprising forming reactive oxygen species within the solution.

13. The method of claim 10, further comprising flowing the leachate to one or more chambers or an electrodialysis stack.

14. The method of claim 10, wherein dissolving at least a portion of the lithium species comprises selectively dissolving the lithium species.

15. The method of claim 10, further comprising grinding or milling the sedimentary ore.

16. A method of leaching lithium into a solution, the method comprising:

exposing sedimentary ore comprising a lithium species to an acid and an oxidant, wherein the acid has a concentration of greater than or equal to 0.1 M and less than or equal to 3 M;

flowing a liquid across the sedimentary ore, the acid, and/or the oxidant;

dissolving at least a portion of the lithium species into the liquid to form a leachate; and forming reactive oxygen species within the solution.

17. The method of claim 16, further comprising suspending the sedimentary ore in a solution comprising the acid and/or the oxidant.

18. The method of claim 16, further comprising flowing the leachate to one or more chambers or an electrodialysis stack.

19. The method of claim 16, wherein dissolving at least a portion of the lithium species comprises selectively dissolving the lithium species.

* * * * *